US008881695B2

(12) United States Patent
Hiyoshi et al.

(10) Patent No.: US 8,881,695 B2
(45) Date of Patent: Nov. 11, 2014

(54) VARIABLE COMPRESSION RATIO INTERNAL COMBUSTION ENGINE

(71) Applicant: Nissan Motor Co., Ltd., Kanagawa (JP)

(72) Inventors: Ryosuke Hiyoshi, Isehara (JP); Katsutoshi Nakamura, Atsugi (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 13/856,189

(22) Filed: Apr. 3, 2013

(65) Prior Publication Data

US 2013/0306035 A1 Nov. 21, 2013

(30) Foreign Application Priority Data

May 18, 2012 (JP) ..... 2012-114037

(51) Int. Cl.
*F02B 75/04* (2006.01)

(52) U.S. Cl.
CPC ..... *F02B 75/047* (2013.01); *F02B 75/048* (2013.01)
USPC ..... 123/48 B; 123/48 A; 123/48 R

(58) Field of Classification Search
CPC ..... F02B 75/048; F02B 75/045; F02B 75/047
USPC .... 123/48 B, 48 R, 48 A, 48 AA, 78 R, 78 A, 123/78 BA, 78 E
See application file for complete search history.

(56) References Cited

U.S. PATENT DOCUMENTS

| | | | | |
|---|---|---|---|---|
| 4,917,066 | A * | 4/1990 | Freudenstein et al. | 123/48 B |
| 6,647,935 | B2 * | 11/2003 | Aoyama et al. | 123/90.16 |
| 6,920,847 | B2 | 7/2005 | Hiyoshi et al. | |
| 7,681,538 | B2 * | 3/2010 | Hiyoshi et al. | 123/48 B |
| 2003/0019448 | A1 * | 1/2003 | Aoyama et al. | 123/90.16 |
| 2004/0083992 | A1 * | 5/2004 | Nohara et al. | 123/78 E |
| 2008/0283008 | A1 * | 11/2008 | Hiyoshi et al. | 123/90.17 |
| 2008/0283027 | A1 * | 11/2008 | Meintschel et al. | 123/48 B |
| 2010/0192915 | A1 * | 8/2010 | Tanaka et al. | 123/48 B |

FOREIGN PATENT DOCUMENTS

JP 2004-257254 A 9/2004

* cited by examiner

*Primary Examiner* — Noah Kamen
*Assistant Examiner* — Long T Tran
(74) *Attorney, Agent, or Firm* — Global IP Counselors, LLP

(57) ABSTRACT

A variable compression ratio internal combustion engine includes a variable compression ratio mechanism, an actuator and a linking mechanism. The actuator is varies and maintains a rotational position of the first control shaft. The linking mechanism includes a second control shaft and a lever. The second control shaft is selectively turned by the actuator. The lever links the second control shaft to the first control shaft such that transference of vibration of the first control shaft to the second control shaft is suppressed. The first control shaft is pivotally linked to a first end of the lever by a first linking pin. The second control shaft is pivotally linked to a second end of the lever by a second linking pin.

19 Claims, 7 Drawing Sheets

VARIABLE COMPRESSION RATIO INTERNAL COMBUSTION ENGINE

CROSS-REFERENCE TO RELATED APPLICATIONS

This application claims priority to Japanese Patent Application No. 2012-114037, filed on May 18, 2012. The entire disclosure of Japanese Patent Application No. 2012-114037 is hereby incorporated herein by reference.

BACKGROUND

1. Field of the Invention

The present invention generally relates to a variable compression ratio internal combustion engine. More specifically, the present invention relates to a variable compression ratio internal combustion engine having a variable compression ratio mechanism capable of varying an engine compression ratio.

2. Background Information

A variable compression ratio mechanism has been previously proposed for varying an engine compression ratio by using a multiple-link piston crank mechanism (see, for example, Japanese Laid-Open Patent Publication No. 2004-257254). Such a variable compression ratio mechanism is configured to control the engine compression ratio according to an operating state of the engine by varying a rotational position of a first control shaft via a motor or another actuator.

SUMMARY

It has been discovered that in the case of a variable compression ratio mechanism having an actuator that is disposed outside of the main engine body to protect the actuator from oil, exhaust heat, or the like, the actuator and a first control shaft are linked by a linking mechanism. In such a structure, the first control shaft is disposed inside the main engine body and a second control shaft of the linking mechanism is disposed outside the main engine body. The first control shaft and the second control shaft are linked by a lever passing through a side wall of the main engine body. The second control shaft is accommodated and disposed inside a housing attached to the side wall of the main engine body, and a motor or another actuator is attached to this housing.

With such a structure, a large combustion load and inertia forces of the main operating components repeatedly act on the first control shaft during engine operation. When the vibration of the first control shaft from such a load is transferred to the actuator, there is a risk that the durability or reliability of the actuator or a decelerator of the linking mechanism will be reduced.

In view of the state of the known technology, one aspect of the present disclosure is to provide a variable compression ratio internal combustion engine that basically comprises a variable compression ratio mechanism, an actuator and a linking mechanism. The variable compression ratio mechanism is configured to vary an engine compression ratio according to a rotational position of a first control shaft. The actuator is configured to vary and maintain the rotational position of the first control shaft. The linking mechanism links the actuator to the first control shaft. The linking mechanism includes a second control shaft and a lever. The second control shaft is selectively turned by the actuator and disposed parallel to the first control shaft. The lever links the second control shaft to the first control shaft such that transference of vibration of the first control shaft to the second control shaft is suppressed by the first control shaft being pivotally linked to a first end of the lever by a first linking pin coupled to a distal end of a first arm that extends outward in a radial direction from the first control shaft, and the second control shaft being pivotally linked to a second end of the lever by a second linking pin coupled to a distal end of a second arm that extends outward in a radial direction from the second control shaft.

Accordingly with the disclosed variable compression ratio internal combustion engine, the transfer of vibrations from the first control shaft to the second control shaft is suppressed. Consequently, vibrations of the first control shaft can be suppressed from being transferred to the actuator.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
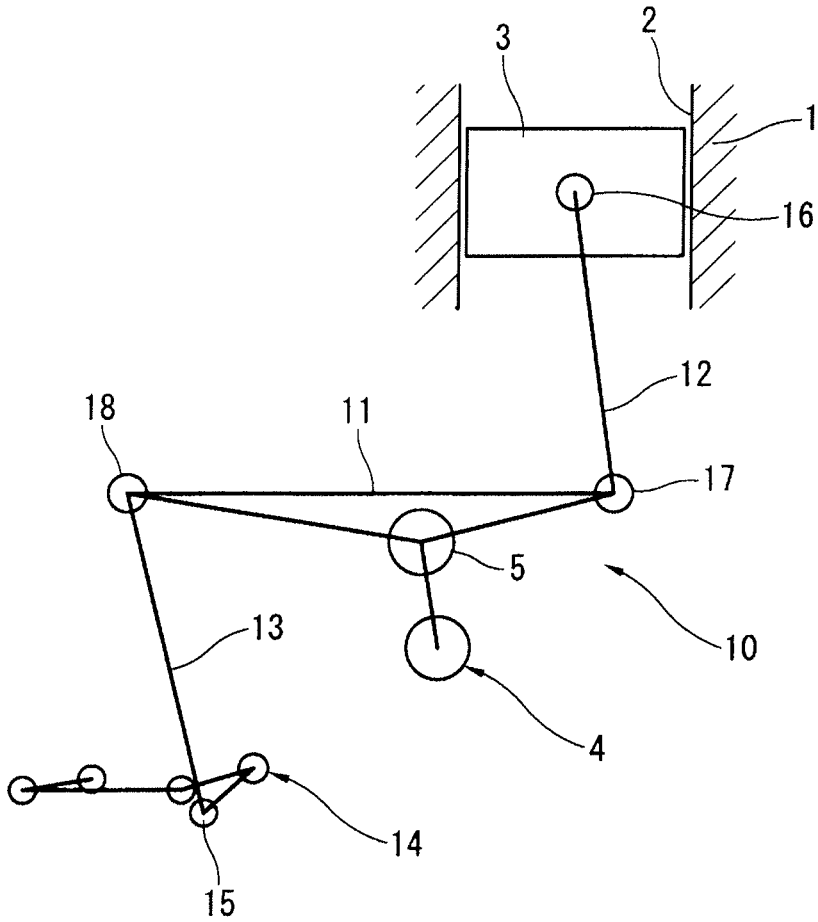
FIG. 1 is a diagrammatic diagram showing a simple depiction of an example of a variable compression ratio mechanism that is utilized in an internal combustion engine of the illustrated embodiments.

Referring initially to FIG. 1, a variable compression ratio mechanism using a multiple-link piston crank mechanism is diagrammatically illustrated that is used in connection with in a first embodiment. The variable compression ratio mechanism is a conventionally known mechanism, which is disclosed in various documents such as in Japanese Laid-Open Patent Publication No. 2004-257254 (U.S. Pat. No. 6,920,847). Thus, only a brief description of the variable compression ratio mechanism will be provided herein.

As seen in FIG. 1, a cylinder block 1 defines a plurality of cylinders 2 (only one shown). The cylinder block 1 constitutes part of a main engine body of an internal combustion engine. A piston 3 is slidably disposed in each of the cylinders 2. A crankshaft 4 is rotatably supported on the cylinder block 1 for moving the pistons 3 (only one shown) within the cylinders 2 (only one shown) in a reciprocating manner. The crankshaft 4 includes a plurality of crank pins 5 (only one shown).

Figure 2:
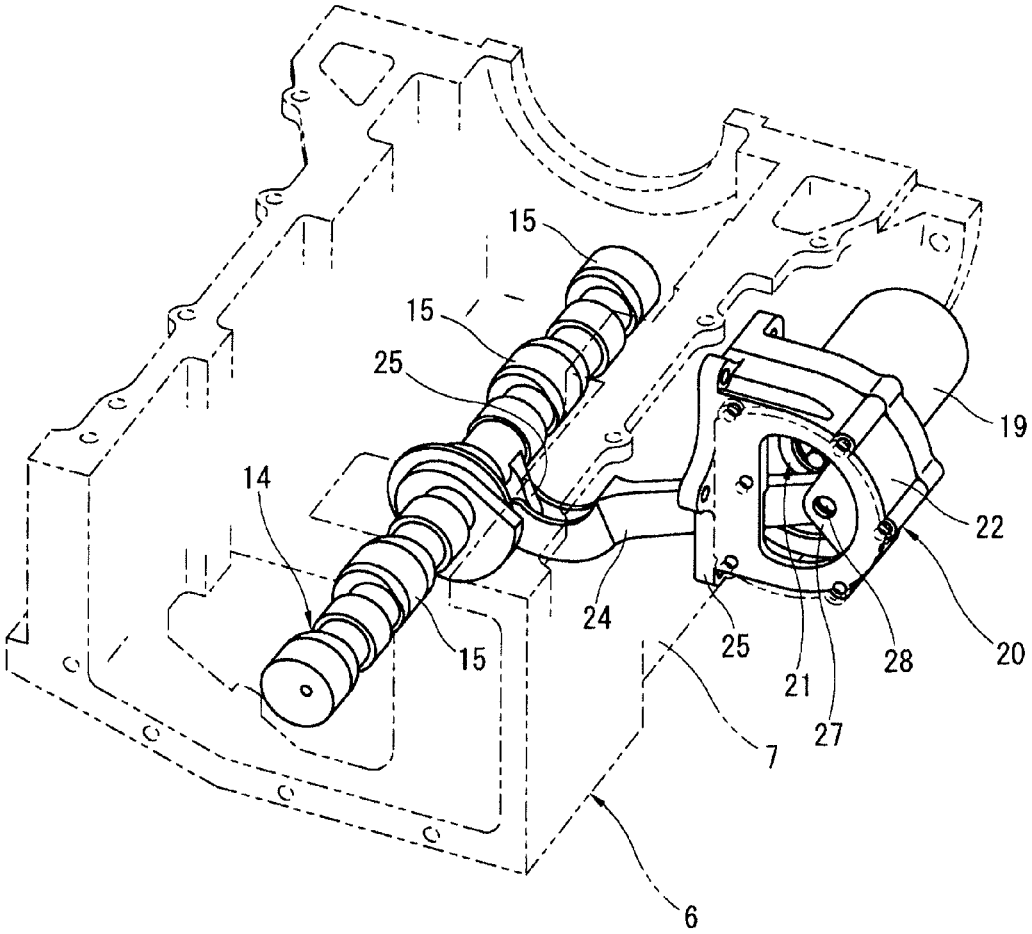
FIG. 2 is a perspective view of a portion of an internal combustion engine showing the linking mechanism that links a first control shaft to a motor of the variable compression ratio mechanism via a second control shaft and a lever.

As seen in FIG. 2, an oil pan upper 6 is fixed to a bottom side of the cylinder block 1 (not shown in FIG. 2) in a conventional manner. The oil pan upper 6 constitutes a part of the main engine body. The oil pan upper 6 has a side wall 7 that is located on an intake side of the oil pan upper 6. The side wall 7 is also referred to below as an "oil pan side wall."

As seen in FIG. 1, a variable compression ratio mechanism 10 basically includes, for each of the cylinders 2, a lower link 11, an upper link 12 and a control link 13. As seen in FIG. 2, the variable compression ratio mechanism 10 also includes a first control shaft 14 with a plurality of control eccentric shaft parts 15 (i.e., one for each of the cylinders 2). The lower link 11 is rotatably attached to the crank pin 5 of the crankshaft 4. The upper link 12 links the lower link 11 and the piston 3 together. The first control shaft 14 is rotatably supported on the cylinder block 1 or another part of the main engine body. The control eccentric shaft parts 15 are eccentrically provided to the first control shaft 14. The control link 13 links the control eccentric shaft part 15 and the lower link 11 together. The piston 3 and the top end of the upper link 12 are linked via a piston pin 16 so as to be capable of rotating relative to each other. The bottom end of the upper link 12 and the lower link 11 are linked via an upper link-side linking pin 17 so as to be capable of rotating relative to each other. The top end of the control link 13 and the lower link 11 are linked via a control link-side linking pin 18 so as to be capable of rotating relative to each other. The bottom end of the control link 13 is rotatably attached to the control eccentric shaft part 15 described above.

Figure 3:
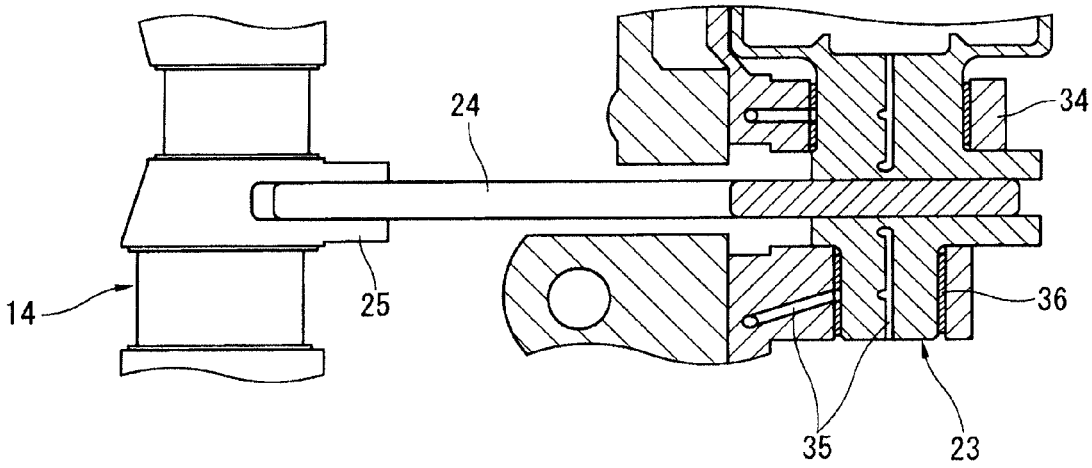
FIG. 3 is a partial cross-sectional view of an internal combustion engine showing the second control shaft of the linking mechanism that is linked to the first control shaft of the variable compression ratio mechanism by a lever.
Figure 4:
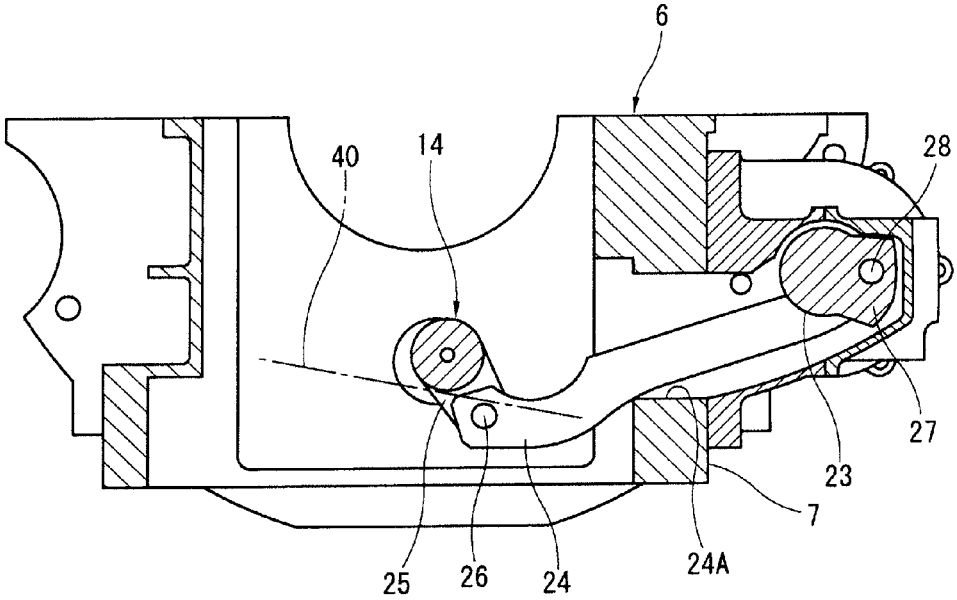
FIG. 4 is a cross-sectional view of the first control shaft of the variable compression ratio mechanism and the second control shaft of the linking mechanism by the lever.

Referring to FIGS. 2 to 4, an electric motor 19 (see FIG. 3) is provided as an actuator of the variable compression ratio mechanism 10. The actuator is not limited to the electric motor 19, and can be a hydraulically driven actuator. The motor 19 is linked to the first control shaft 14 via a linking mechanism 20. Due to the rotational position of the first control shaft 14 being varied by the motor 19, piston stroke characteristics of the pistons 3 are changes. In particular, these changes of the piston stroke characteristics of the pistons 3 include the piston top dead center position and the piston bottom dead center position changing, as well as the engine compression ratio changing an the orientation of the lower link 11 changing. Therefore, the engine compression ratio can be controlled according to the operating state of the engine by driveably controlling the motor 19 via a controller (not shown).

The first control shaft 14 and the motor 19 are mechanically linked by the linking mechanism 20 comprising the decelerator 21. The first control shaft 14 is rotatably supported in the interior of the main engine body, which in the illustrated embodiment includes the cylinder block 1, the oil pan upper 6 and other components (not shown). In the illustrated embodiment, the motor 19 is disposed outside of the main engine body. More specifically, the motor 19 is attached to the engine-rear side of a housing 22 that is attached to the oil pan side wall 7, which is located on the intake side of the oil pan upper 6.

The decelerator 21 decelerates the rotation of the output shaft of the motor 19 and transfers the rotation to the first control shaft 14. In the illustrated embodiment, the decelerator 21 includes a Harmonic Drive™ mechanism. A description of the decelerator 21 is omitted herein because the structure of the decelerator 21 is the same as that disclosed in Japanese Patent Application No. 2011-259752. The decelerator 21 is not limited to a structure that uses such a Harmonic Drive™ mechanism. Rather, other types of gear ratio reduction mechanism can be used such as, for example, another form of decelerator, such as a cyclo decelerator, can be used.

The linking mechanism 20 includes a second control shaft 23, which is the output shaft of the decelerator 21. The second control shaft 23 is accommodated and rotatably disposed inside the housing 22. The second control shaft 23 extends alongside the oil pan side wall 7. The second control shaft 23 extends in the longitudinal direction of the engine (i.e. a direction parallel to the first control shaft 14). The first control shaft 14 is rotatably disposed inside the main engine body where lubricating oil scatters. The second control shaft 23 is provided outside of the main engine body. The first control shaft 14 and the second control shaft 23 are mechanically linked together by a lever 24. The lever 24 passes through an opening or slit 24A that is formed in the oil pan side wall 7. The housing 22 is laid alongside the oil pan side wall 7 so as to close off the slit 24A. The first control shaft 14 and the second control shaft 23 rotate in conjunction with each other via the lever 24.

As shown in FIG. 4, the first control shaft 14 and the second control shaft 23 are linked via the lever 24 in such a manner to suppress transference of vibration of the first control shaft 14 to the second control shaft 23. Basically, this suppression of vibration is at least partially accomplished by the lever 24 being pivotally coupled to both the first control shaft 14 and the second control shaft 23. In particular, the first control shaft 14 is provided with a first arm 25. The first control shaft 14 is pivotally linked to a first end of the lever 24 by a first linking pin 26 that is also pivotally coupled to a distal end of the first arm 25 of the first control shaft 14. The distal end of the first arm 25 extends outward in a radial direction from the first control shaft 14. Specifically, the distal end of the first arm 25 extends farther outward in the radial direction of the first control shaft 14 than an axial middle part of the first control shaft 14. The second control shaft 23 is provided with a second arm 27. The second control shaft 23 is pivotally linked to a second end of the lever 24 by a second linking pin 28 that is also pivotally coupled to a distal end of the second arm 27 of the second control shaft 23. The distal end of the second arm 27 extends outward in a radial direction from the second control shaft 23. Specifically, the distal end of the second arm 27 extends farther outward in the radial direction than an axial middle part of the second control shaft 23.

In FIG. 3, the first arm 25 is illustrated as a bifurcated arm with the first end of the lever 24 being disposed between two portions of the first arm 25. However, as illustrated in FIG. 2, the lever 24 has a bifurcated first end with the first arm 25 being disposed between two portions of the lever 24. Thus, while the following embodiments are illustrated with the first arm 25 being bifurcated, it will be apparent to those skilled in the field of engines from this disclosure that the lever 24 of the following embodiments can have a bifurcated first end such as shown in FIG. 2.

Figure 5:
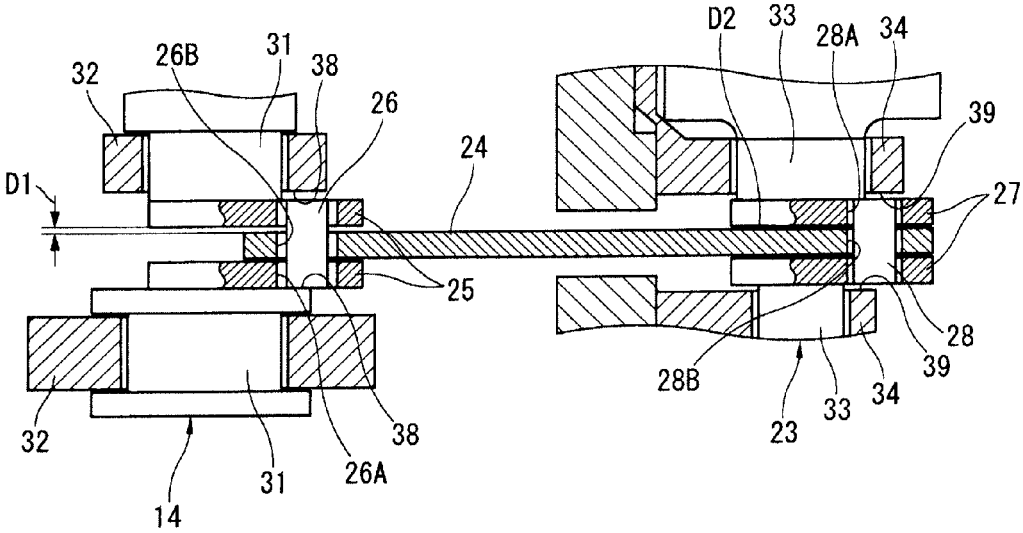
FIG. 5 is a partial cross-sectional view of the first control shaft of the variable compression ratio mechanism and the second control shaft of the linking mechanism by the lever in accordance with a first embodiment.

As shown in FIG. 5, the first control shaft 14 is provided with a pair of first journal sections 31 positioned on axial sides of the first arm 25 of the first control shaft 14. The first journal sections 31 are rotatably supported by a pair of first bearings 32. Similarly, the second control shaft 23 is provided with a pair of second journal sections 33 positioned on axial sides of the second arm 27 of the second control shaft 23. The second journal sections 33 are rotatably supported by a pair of second bearings 34. The first bearings 32 are omitted from FIG. 3. As shown in FIG. 3, the second bearings 34 are each provided with an oil channel 35 for supplying oil to bearing portions of the second bearings 34. Each of the second bearings 34 can be provided with a metal bearing part or sleeve 36 that constitutes a cylindrical bearing surface as needed and/or desired.

The first linking pin 26 has a full-floating linking structure capable of rotating relative to both the first arm 25 of the first control shaft 14 and the lever 24. The first arm 25 has a pin hole 26A for receiving the first linking pin 26, while the lever 24 has a pin hole 26B for receiving the first linking pin 26. A predetermined clearance in the radial direction is ensured between the first linking pin 26 and the pin holes 26A and 26B through which the first linking pin 26 is inserted, as shown in FIG. 5. Similarly, the second linking pin 28 has a full-floating linking structure capable of rotating relative to both the second arm 27 of the second control shaft 23 and the lever 24. The second arm 27 has a pin hole 28A for receiving the second linking pin 28, while the lever 24 has a pin hole 28B for receiving the second linking pin 28. A predetermined clearance in the radial direction is ensured between the second linking pin 28 and the pin holes 28A and 28B through which the second linking pin 28 is inserted.

The first linking pin 26 is retained by a pair of oppositely facing thrust surfaces 38. One of the thrust surfaces 38 is formed by the first control shaft 14 and the other of the thrust surfaces 38 is formed by one of the first bearings 32. The thrust surfaces 38 face the axial end surfaces of the first linking pin 26, and are capable of contacting with these end surfaces, respectively to limit axial movement of the first linking pin 26. Similarly, the second linking pin 28 is retained by a pair of oppositely facing thrust surfaces 39. One of the thrust surfaces 39 is formed by the second control shaft 23 and the other of the thrust surfaces 39 is formed by one of the second bearings 34. The thrust surfaces 39 face the axial end surfaces of the second linking pin 28, and are capable of contacting with these end surfaces, respectively to limit axial movement of the second linking pin 28.

Next, the characteristic configuration and operational effects of the variable compression ratio internal combustion engine having the disclosed configuration are described in detail with reference to the embodiments shown in FIGS. 5 to 11.

(1) As described in more detail in (2) through (10) hereinafter, the linking structure of the first control shaft 14 and the second control shaft 23 are linked via the lever 24 such that the linking structure suppresses the transference of vibration of the first control shaft 14 to the second control shaft 23. Thereby, the transference of vibration from the first control shaft 14 to the second control shaft 23 can be suppressed, the vibration transferred to the decelerator 21 or to the motor 19 (the actuator) can consequently be reduced. As a result, wear due to fretting of the gears of the decelerator 21 can be suppressed, the occurrence of failures due to breaking of the coils of the motor 19 can be suppressed, and the durability and reliability of the decelerator 21 and motor 19 can be improved.

(2) In the first embodiment, as shown in FIG. 5, the first arm 25 of the first control shaft 14 and the lever 24 are axially arranged on the first linking pin 26 to provide a predetermined axial clearance D1 between the axial side surface of the first control shaft 14 and the opposing axial side surface of the lever 24 to allow for axial movement. On the other hand, the second arm 27 of the second control shaft 23 and the lever 24 are axially arranged on second linking pin 28 to provide a predetermined axial clearance D2 between the axial side surface of the second control shaft 23 and the opposing axial side surface of the lever 24, where the predetermined axial clearance D2 is set either to 0 (zero) or to an extremely small value near 0 so that the two axial side surfaces are substantially in contact with each other.

Thus, because the predetermined axial clearance D1 is ensured between the first control shaft 14 and the lever 24, when the first control shaft 14 vibrates, the vibration is absorbed or canceled out by the axial clearance D1 and suppressed from being transferred to the lever 24, and the transference of vibration to the second control shaft 23 can consequently be suppressed. In other words, even if the first control shaft 14 tilts in a direction inclined relative to the axial direction when the first control shaft 14 vibrates, the displacement caused by this tilt is absorbed or canceled out by the axial clearance D1. Thus, the lever 24 is therefore suppressed from following the first control shaft 14 and being displaced in a collapsing direction. Therefore, the acting of a bending moment on the lever 24 is suppressed, whereby it is possible to suppress uneven wear due to partial contact of the bearing portions and buckling due to the effects of the combustion load during bending deformation. Because the bending stress acting on the lever 24 is suppressed, collapsing and bending of the lever 24 is suppressed as well. Partial contact of the bearing portions between the second linking pin 28 and the second arm 27 of the second control shaft 23 can thereby be suppressed, and wear in the second linking pin 28 and the bearing portion thereof can also be suppressed.

Setting a larger axial (thrust direction) clearance D1 in the first control shaft 14 which vibrates more than the second control shaft 23 makes it possible to suppress vibration in the lever 24 occurring due to vibration in thrust-direction components from among the vibration occurring in the first control shaft 14 due to the combustion load and inertia force of the main operating components. This structure also makes it possible to suppress the transference of vibration to the actuator via the lever 24.

Furthermore, because the axial dimension of the second control shaft 23 can be reduced, the entire length of the actuator can be reduced. In the case of a configuration opposite that of the present embodiment (the axial clearance D2 between the second control shaft and the lever is set to be relatively large), the vibration of the lever 24 increases along with the vibration of the first control shaft 14, and the vibration is amplified and transferred to the second control shaft 23. Therefore, the clearance must be increased in order to avoid collisions with the second control shaft 23, leading to an increase in size.

Figure 6:
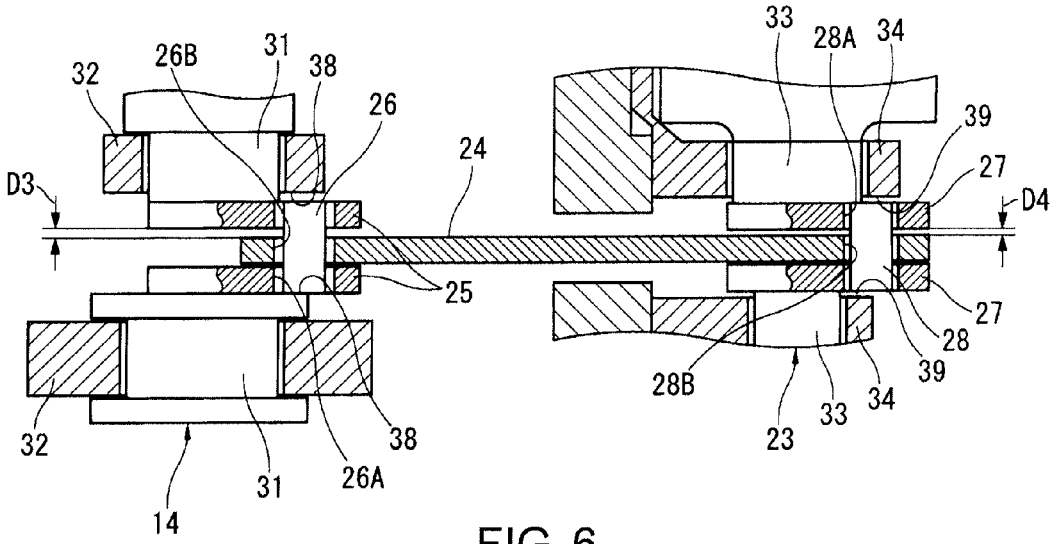
FIG. 6 is a partial cross-sectional view of the first control shaft of the variable compression ratio mechanism and the second control shaft of the linking mechanism by the lever in accordance with a second embodiment.

(3) In the second embodiment, as shown in FIG. 6, an axial clearance D3 between the axial side surface of the first control shaft 14 and the opposing axial side surface of the lever 24 is set greater than an axial clearance D4 between the axial side surface of the second control shaft 23 and the opposing axial side surface of the lever 24. In other words, although the axial clearance D4 is ensured between the second control shaft 23 and the lever 24, the size thereof is set to be smaller than the axial clearance D3 between the first control shaft 14 and the lever 24. As in the first embodiment, the operational effects cited in (2) above can be achieved in this case as well.

Figure 7:
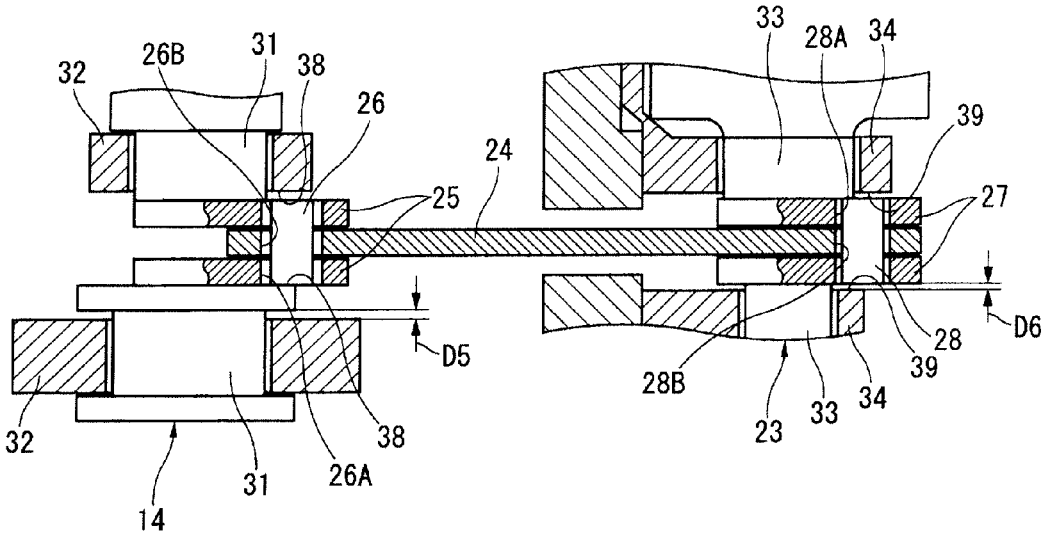
FIG. 7 is a partial cross-sectional view of the first control shaft of the variable compression ratio mechanism and the second control shaft of the linking mechanism by the lever in accordance with a third embodiment.

(4) In the third embodiment, as shown in FIG. 7, the axial clearance D5 between the axial side surface of one of the first bearings 32 and the opposing axial side surface of the first control shaft 14 is set greater than an axial clearance D6 between the axial side surface of one of the second bearings 34 and the opposing axial side surface of the second control shaft 23. Thus, setting the axial clearance D6 of the second control shaft to be smaller than the axial clearance D5 of the first control shaft makes it possible to reduce positional misalignment in the thrust direction of the lever 24 whose thrust position (axial position) is established by the second control shaft 23, and also makes it possible to suppress collapsing of the second arm 27 of the second control shaft 23 and consequently to suppress collapsing of the lever 24. Therefore, thrust-direction misalignment in the first control shaft-side portion of the lever 24 can be reduced, whereby vibration of the first control shaft 14 repeatedly subjected to the combustion load or the inertial force of the main operating components can be suppressed, collisions between the lever 24 and the first arm 25 of the first control shaft 14 can be suppressed or avoided, and the transference of vibration from the first control shaft 14 to the second control shaft and the actuator via the lever 24 can consequently be suppressed.

Figure 8:
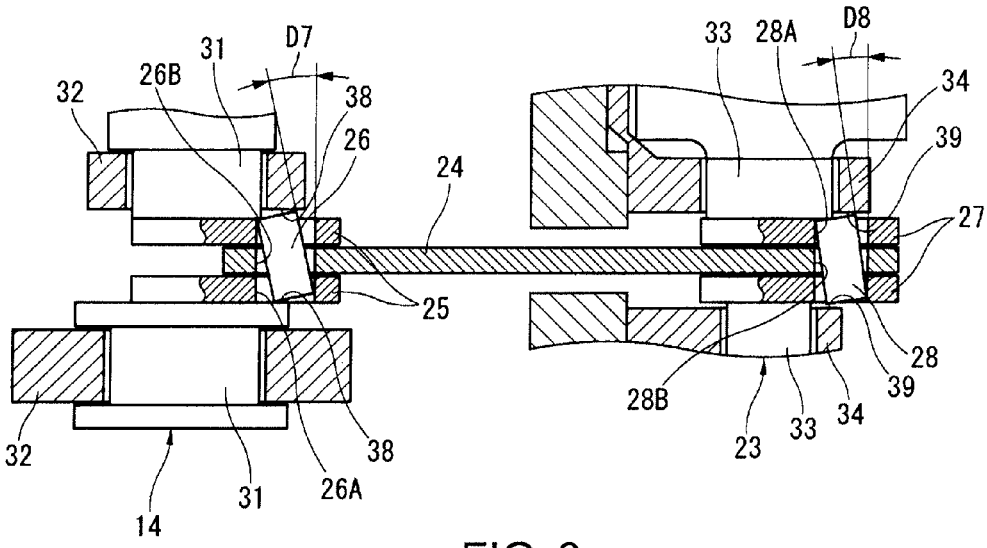
FIG. 8 is a partial cross-sectional view of the first control shaft of the variable compression ratio mechanism and the second control shaft of the linking mechanism by the lever in accordance with a fourth embodiment.

(5) In the fourth embodiment, as shown in FIG. 8, a maximum collapse angle D7 of the first linking pin 26 relative to the axial direction of the first control shaft 14 is set greater than a maximum collapse angle D8 of the second linking pin 28 relative to the axial direction of the second control shaft 23. Thus, due to a greater collapse angle, i.e. clearance in an inclined direction being set in the first control shaft 14 which vibrates more than the second control shaft 23, displacement of the lever 24 in the inclined direction that comes with collapsing of the first arm 25 can be suppressed even when the first arm 25 of the first control shaft 14 is tilted by the combustion load or the inertial force of the main operating components. Therefore, increases in vibration in the lever 24 can be suppressed, and the transference of vibration from the first control shaft via the lever 24 to the second control shaft 23 and the actuator can consequently be suppressed. This configuration of the maximum collapse angles D7 and D8 of the fourth embodiment of FIG. 8 is also inherently present in the first to third embodiments as illustrated. However, this configuration of the maximum collapse angles D7 and D8 can be omitted from the first to third embodiments if needed and/or desired.

Figure 9:
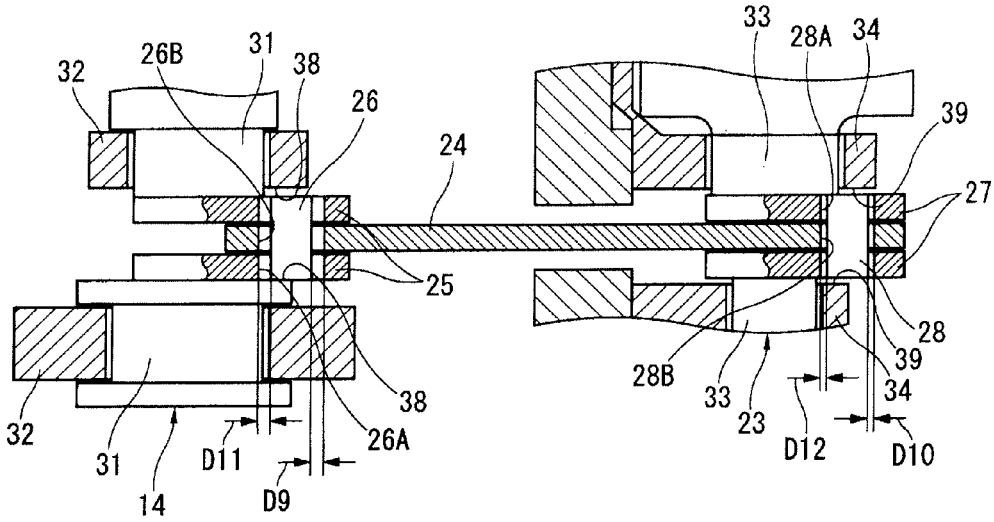
FIG. 9 is a partial cross-sectional view of the first control shaft of the variable compression ratio mechanism and the second control shaft of the linking mechanism by the lever in accordance with a fifth embodiment.

(6) In the fifth embodiment, as shown in FIG. 9, a radial clearance D9 between an external peripheral surface of the first linking pin 26 and an internal peripheral surface of the first pin hole 26A of the first control shaft 14 in which the first linking pin 26 is inserted is set greater than the radial clearance D10 between an external peripheral surface of the second linking pin 28 and an internal peripheral surface of the second pin hole 28A of the second control shaft 23 in which the second linking pin 28 is inserted. Due to a greater radial clearance D9 thus being set in the first control shaft 14 which vibrates more, of the vibration occurring in the first control shaft 14 due to the combustion load and inertial force of the main operating components, the component in the bending direction or collapsing direction of the first control shaft 14 can be effectively suppressed from being transferred to the actuator via the lever 24. A bending load originating in the bending or collapsing of the first control shaft 14 can also be suppressed from acting on the lever 24; therefore, stress acting on the lever 24 can be suppressed, and the occurrence of partial contact and the progression of wear in the linking pin bearing portions can be suppressed. This configuration of the radial clearances D9 and D10 of the fifth embodiment of FIG. 9 is also inherently present in the first to fourth embodiments as illustrated. However, this configuration of the radial clearances D9 and D10 can be omitted from the first to third embodiments if needed and/or desired.

(7) A total value (D9+D11) of the radial clearance D9 between the external peripheral surface of the first linking pin 26 and the internal peripheral surface of the first pin hole 26A of the first control shaft 14 in which the first linking pin 26 is inserted, and the radial clearance D11 between the external peripheral surface of the first linking pin 26 and the internal peripheral surface of the third pin hole 26B of the lever 24 in which the first linking pin 26 is inserted, is set greater than a total value (D10+D12) of the radial clearance D10 between the external peripheral surface of the second linking pin 28 and the internal peripheral surface of the second pin hole 28A of the second control shaft 23 in which the second linking pin 28 is inserted, and the radial clearance D12 between the external peripheral surface of the second linking pin 28 and the internal peripheral surface of the fourth pin hole 28B of the lever 24 in which the second linking pin 28 is inserted, as shown in FIG. 9. The operational effects cited in (6) above can thereby be achieved with greater certainty.

Figure 10:
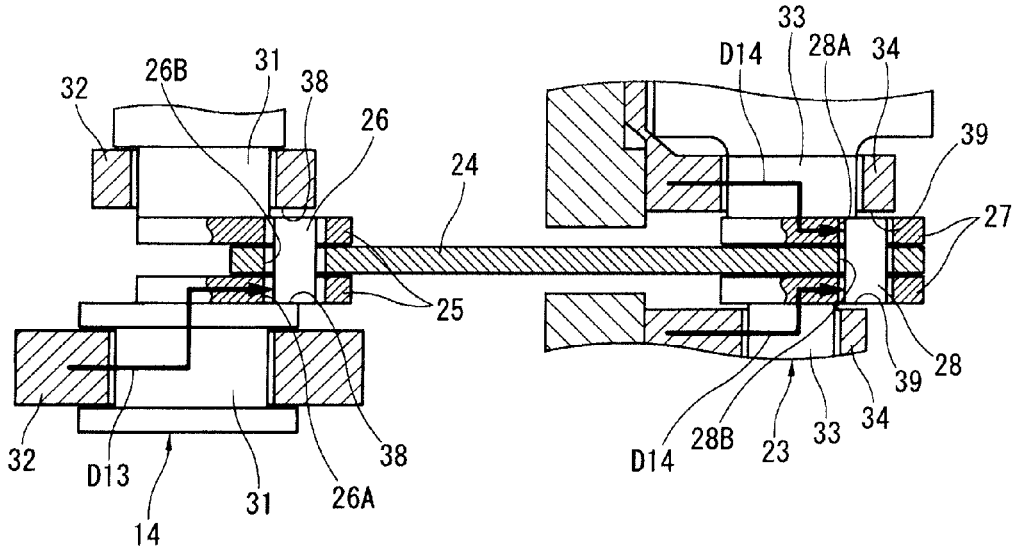
FIG. 10 is a partial cross-sectional view of the first control shaft of the variable compression ratio mechanism and the second control shaft of the linking mechanism by the lever in accordance with a sixth embodiment.

(8) In the sixth embodiment, as shown in FIG. 10, an amount of oil force-fed by the second linking pin 28 to the bearing portion between the second control shaft 23 and the lever 24 (see arrow D13) is set greater than the amount of oil force-fed by the first linking pin 26 to the bearing portion between the first control shaft 14 and the lever 24. Specifically, the oil channel 35 (see FIG. 3) is formed for forcefully supplying oil to only the bearing portion between the second control shaft 23 and the lever 24. Thus, the clearance of the second control shaft can be set smaller as described above without compromising lubrication by increasing the amount of lubricating oil to the bearing portion between the second control shaft 23 and the lever 24. In the bearing portion of the first control shaft, a force-feeding structure that uses an oil channel can be omitted and the configuration can be simplified without compromising lubrication, because either the bearing portion is immersed in the oil retained in the oil pan, or the bearing portion is sufficiently lubricated by the oil mist scattered into the oil pan. This configuration of the differing amounts of oil force-fed to the first and second linking pin 28 of the sixth embodiment of FIG. 10 is also preferably present in the first to fifth embodiments as illustrated. However, this configuration of the differing amounts of oil force-fed to the first and second linking pin 28 can be omitted from the first to fifth embodiments if needed and/or desired.

Figure 11:
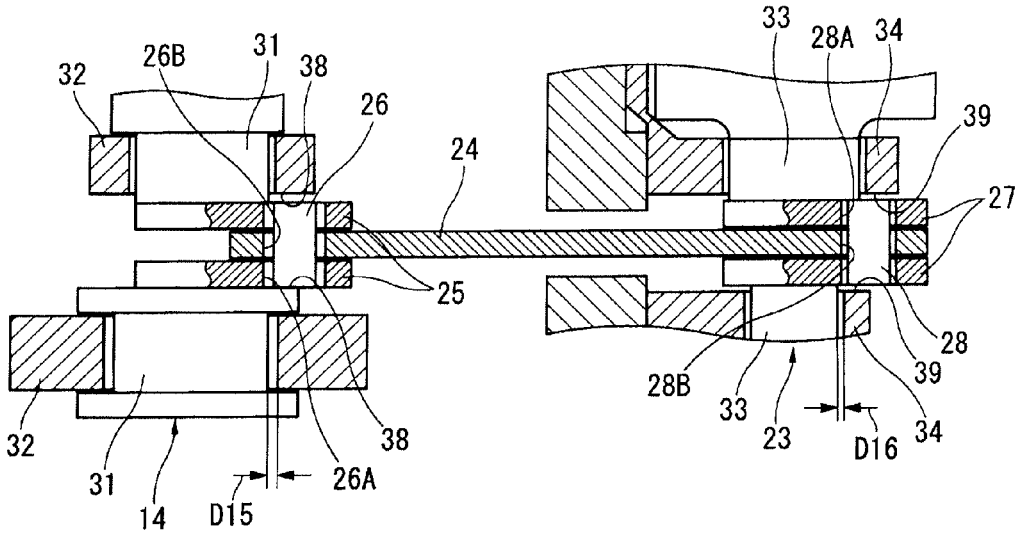
FIG. 11 is a partial cross-sectional view of the first control shaft of the variable compression ratio mechanism and the second control shaft of the linking mechanism by the lever in accordance with a seventh embodiment.

(9) In the seventh embodiment shown in FIG. 11, a radial clearance D16 between an external peripheral surface of one second journal section 33 and an internal peripheral surface of one of the second bearings 34 is set to be smaller than the radial clearance D15 between an external peripheral surface of one of the first journal sections 31 and an internal peripheral surface of one of the first bearings 32. Although the lever 24 also collapses due to the collapsing of the second control shaft 23 wherein the second control shaft 23 is displaced in a direction inclined relative to the axial direction, because the radial clearance D16 between the second control shaft 23 and the lever 24 is set to be smaller, it is possible to avoid an increase in the amount of collapse in the distal end portion of the lever 24 on the side of the first control shaft 14, and collisions between the first control shaft 14 and the lever 24 can be suppressed or avoided.

(10) Though not illustrated, the first pin hole 26A of the first control shaft 14 in which the first linking pin 26 is inserted is not immersed in oil, while the second pin hole 28A of the second control shaft 23 in which the second linking pin 28 is inserted is immersed in oil. More lubricating oil can thereby be supplied to the second linking pin 28, and it is therefore possible to suppress wear in contacting sections and to alleviate abnormal noises caused by contact between components, even when the clearance of bearing portions in the second control shaft 23 is set to be lower as described above. However, immersing the first linking pin 26 in oil makes it possible to suppress the increase in stirring resistance due to the swinging control link 13 being immersed in oil, and the resulting increase in friction loss can be suppressed. To ensure lubrication performance in the bearing portion of the first linking pin 26, the bearing portion of the first linking pin 26 can be disposed and immersed lower than the oil level 40 of oil retained in the oil pan, as shown in FIG. 4.

While only selected embodiments have been chosen to illustrate the present invention, it will be apparent to those skilled in the art from this disclosure that various changes and modifications can be made herein without departing from the scope of the invention as defined in the appended claims. For example, the structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A variable compression ratio internal combustion engine comprising:

a variable compression ratio mechanism configured to vary an engine compression ratio according to a rotational position of a first control shaft;

an actuator configured to vary and maintain the rotational position of the first control shaft; and a linking mechanism linking the actuator to the first control shaft, the linking mechanism including a second control shaft and a lever, the second control shaft being selectively turned by the actuator and disposed parallel to the first control shaft, the lever linking the second control shaft to the first control shaft such that transference of vibration of the first control shaft to the second control shaft is suppressed by the first control shaft being pivotally linked to a first end of the lever by a first linking pin coupled to a distal end of a first arm that extends outward in a radial direction from the first control shaft, and the second control shaft being pivotally linked to a second end of the lever by a second linking pin coupled to a distal end of a second arm that extends outward in a radial direction from the second control shaft.

2. The variable compression ratio internal combustion engine according to claim 1, wherein a predetermined axial clearance is ensured between an axial side surface of the first control shaft and an opposing axial side surface of the lever; and an axial side surface of the second control shaft and an opposing axial side surface of the lever are in contact with each other.

3. The variable compression ratio internal combustion engine according to claim 2, wherein a maximum collapse angle of the first linking pin relative to an axial direction of the first control shaft is greater than a maximum collapse angle of the second linking pin relative to an axial direction of the second control shaft.

4. The variable compression ratio internal combustion engine according to claim 3, wherein a radial clearance between an external peripheral surface of the first linking pin and an internal peripheral surface of a first pin hole of the first control shaft in which the first linking pin is disposed is greater than a radial clearance between an external peripheral surface of the second linking pin and an internal peripheral surface of a second pin hole of the second control shaft in which the second linking pin is disposed.

5. The variable compression ratio internal combustion engine according to claim 2, wherein a radial clearance between an external peripheral surface of the first linking pin and an internal peripheral surface of a first pin hole of the first control shaft in which the first linking pin is disposed is greater than a radial clearance between an external peripheral surface of the second linking pin and an internal peripheral surface of a second pin hole of the second control shaft in which the second linking pin is disposed.

6. The variable compression ratio internal combustion engine according to claim 2, wherein a total value of a radial clearance between an external peripheral surface of the first linking pin and an internal peripheral surface of a first pin hole of the first control shaft in which the first linking pin is disposed, and a radial clearance between the external peripheral surface of the first linking pin and an internal peripheral surface of a third pin hole of the lever in which the first linking pin is disposed, is greater than a total value of a radial clearance between an external peripheral surface of the second linking pin and an internal peripheral surface of a second pin hole of the second control shaft in which the second linking pin is inserted, and a radial clearance between the external peripheral surface of the second linking pin and an internal peripheral surface of a fourth pin hole of the lever in which the second linking pin is disposed.

7. The variable compression ratio internal combustion engine according to claim 2, wherein an amount of oil force-fed by the second linking pin to a bearing portion between the second control shaft and the lever is greater than an amount of oil force-fed by the first linking pin to a bearing portion between the first control shaft and the lever.

8. The variable compression ratio internal combustion engine according to claim 1, wherein an axial clearance between an axial side surface of the first control shaft and an opposing axial side surface of the lever is greater than an axial clearance between an axial side surface of the second control shaft and an opposing axial side surface of the lever.

9. The variable compression ratio internal combustion engine according to claim 8, wherein a maximum collapse angle of the first linking pin relative to an axial direction of the first control shaft is greater than a maximum collapse angle of the second linking pin relative to an axial direction of the second control shaft.

10. The variable compression ratio internal combustion engine according to claim 9, wherein a radial clearance between an external peripheral surface of the first linking pin and an internal peripheral surface of a first pin hole of the first control shaft in which the first linking pin is disposed is greater than a radial clearance between an external peripheral surface of the second linking pin and an internal peripheral surface of a second pin hole of the second control shaft in which the second linking pin is disposed.

11. The variable compression ratio internal combustion engine according to claim 8, wherein a radial clearance between an external peripheral surface of the first linking pin and an internal peripheral surface of a first pin hole of the first control shaft in which the first linking pin is disposed is greater than a radial clearance between an external peripheral surface of the second linking pin and an internal peripheral surface of a second pin hole of the second control shaft in which the second linking pin is disposed.

12. The variable compression ratio internal combustion engine according to claim 8, wherein a total value of a radial clearance between an external peripheral surface of the first linking pin and an internal peripheral surface of a first pin hole of the first control shaft in which the first linking pin is disposed, and a radial clearance between the external peripheral surface of the first linking pin and an internal peripheral surface of a third pin hole of the lever in which the first linking pin is disposed, is greater than a total value of a radial clearance between an external peripheral surface of the second linking pin and an internal peripheral surface of a second pin hole of the second control shaft in which the second linking pin is inserted, and a radial clearance between the external peripheral surface of the second linking pin and an internal peripheral surface of a fourth pin hole of the lever in which the second linking pin is disposed.

13. The variable compression ratio internal combustion engine according to claim 8, wherein an amount of oil force-fed by the second linking pin to a bearing portion between the second control shaft and the lever is greater than an amount of oil force-fed by the first linking pin to a bearing portion between the first control shaft and the lever.

14. The variable compression ratio internal combustion engine according to claim 1, further comprising a pair of first bearings rotatably supporting a pair of first journal sections of the first control shaft; and a pair of second bearings rotatably supporting a pair of second journal sections of the second control shaft;

an axial clearance between an axial side surface of one of the first bearings and an opposing axial side surface of the first control shaft is greater than an axial clearance between an axial side surface of one of the second bearings and an opposing axial side surface of the second control shaft.

15. The variable compression ratio internal combustion engine according to claim 1, wherein a maximum collapse angle of the first linking pin relative to an axial direction of the first control shaft is greater than a maximum collapse angle of the second linking pin relative to an axial direction of the second control shaft.

16. The variable compression ratio internal combustion engine according to claim 1, wherein an amount of oil force-fed by the second linking pin to a bearing portion between the second control shaft and the lever is greater than an amount of oil force-fed by the first linking pin to a bearing portion between the first control shaft and the lever.

17. The variable compression ratio internal combustion engine according to claim 1, further comprising a pair of first bearings rotatably supporting a pair of first journal sections of the first control shaft; and a pair of second bearings rotatably supporting a pair of second journal sections of the second control shaft;

a radial clearance between an external peripheral surface of one of the first journal sections and an internal peripheral surface of one of the first bearings is smaller than a radial clearance between an external peripheral surface of one of the second journal sections and an internal peripheral surface of one of the second bearings.

18. A variable compression ratio internal combustion engine comprising:

a variable compression ratio mechanism configured to vary an engine compression ratio according to a rotational position of a first control shaft;

an actuator configured to vary and maintain the rotational position of the first control shaft; and a linking mechanism linking the actuator to the first control shaft, the linking mechanism including a second control shaft and a lever, the second control shaft being selectively turned by the actuator and disposed parallel to the first control shaft, the lever linking the second control shaft to the first control shaft such that transference of vibration of the first control shaft to the second control shaft is suppressed by the first control shaft being pivotally linked to a first end of the lever by a first linking pin coupled to a distal end of a first arm that extends outward in a radial direction from the first control shaft, and the second control shaft being pivotally linked to a second end of the lever by a second linking pin coupled to a distal end of a second arm that extends outward in a radial direction from the second control shaft, and a radial clearance between an external peripheral surface of the first linking pin and an internal peripheral surface of a first pin hole of the first control shaft in which the first linking pin is disposed being greater than a radial clearance between an external peripheral surface of the second linking pin and an internal peripheral surface of a second pin hole of the second control shaft in which the second linking pin is disposed.

19. A variable compression ratio internal combustion engine comprising:

a variable compression ratio mechanism configured to vary an engine compression ratio according to a rotational position of a first control shaft;

an actuator configured to vary and maintain the rotational position of the first control shaft; and a linking mechanism linking the actuator to the first control shaft, the linking mechanism including a second control shaft and a lever, the second control shaft being selectively turned by the actuator and disposed parallel to the first control shaft, the lever linking the second control shaft to the first control shaft such that transference of vibration of the first control shaft to the second control shaft is suppressed by the first control shaft being pivotally linked to a first end of the lever by a first linking pin coupled to a distal end of a first arm that extends outward in a radial direction from the first control shaft, and the second control shaft being pivotally linked to a second end of the lever by a second linking pin coupled to a distal end of a second arm that extends outward in a radial direction from the second control shaft, and a total value of a radial clearance between an external peripheral surface of the first linking pin and an internal peripheral surface of a first pin hole of the first control shaft in which the first linking pin is disposed, and a radial clearance between the external peripheral surface of the first linking pin and an internal peripheral surface of a third pin hole of the lever in which the first linking pin is disposed, is greater than a total value of a radial clearance between an external peripheral surface of the second linking pin and an internal peripheral surface of a second pin hole of the second control shaft in which the second linking pin is inserted, and a radial clearance between the external peripheral surface of the second linking pin and an internal peripheral surface of a fourth pin hole of the lever in which the second linking pin is disposed.

* * * * *